US006056101A

United States Patent [19]

Kataoka

[11] Patent Number: 6,056,101

[45] Date of Patent: May 2, 2000

[54] OVERLOAD CONTROL MECHANISM FOR CARGO HANDLING MACHINE

[75] Inventor: Kozo Kataoka, Osaka, Japan

[73] Assignee: H.H.H. Manufacturing Co., Osaka, Japan

[21] Appl. No.: 09/007,937

[22] Filed: Jan. 16, 1998

[30] Foreign Application Priority Data

Jan. 31, 1997 [JP] Japan ..... 9-032685

[51] Int. Cl.[7] ..... B66D 5/00

[52] U.S. Cl. ..... 192/150; 192/55.1; 192/56.6; 192/66.21

[58] Field of Search ..... 192/150, 55.1, 192/56.1, 56.2, 56.6, 66.21, 66.22, 66.23; 464/42, 43

[56] References Cited

U.S. PATENT DOCUMENTS

| | | | |
|---|---|---|---|
| 2,412,157 | 12/1946 | Kronquest | 192/56.57 |
| 2,510,469 | 6/1950 | Greenlee | 475/315 |
| 3,024,630 | 3/1962 | Billups | 464/8 |
| 3,648,483 | 3/1972 | Garcia, Jr. | 464/43 |
| 5,593,119 | 1/1997 | Moore et al. | 248/185.1 |

*Primary Examiner*—Charles A. Marmor
*Assistant Examiner*—Saúl Rodriguez
*Attorney, Agent, or Firm*—Thompson Hine & Flory LLP

[57] ABSTRACT

An overload control mechanism working as a safety mechanism for preventing a fall of cargo when a machine is overloaded during cargo handling operation. The overload control mechanism includes a driving gear, a tapered disk arranged on the inner circumference of the driving gear and tapered to the axis of the driving gear, a first friction disk having a tapered friction surface in contact with the tapered surface on the inner side of the tapered disk, for fixing a spindle that is inserted through the first friction disk, and a second friction disk having a tapered friction surface in contact with the tapered surface on the outer side of the tapered disk. Both the first friction disk and the second friction disk with the tapered disk of the driving gear clamped therebetween rotate integrally. The second friction disk is fastened by a nut which is tightened onto a support shaft of the first friction disk with a spring therebetween.

6 Claims, 5 Drawing Sheets

*Figure 1A*
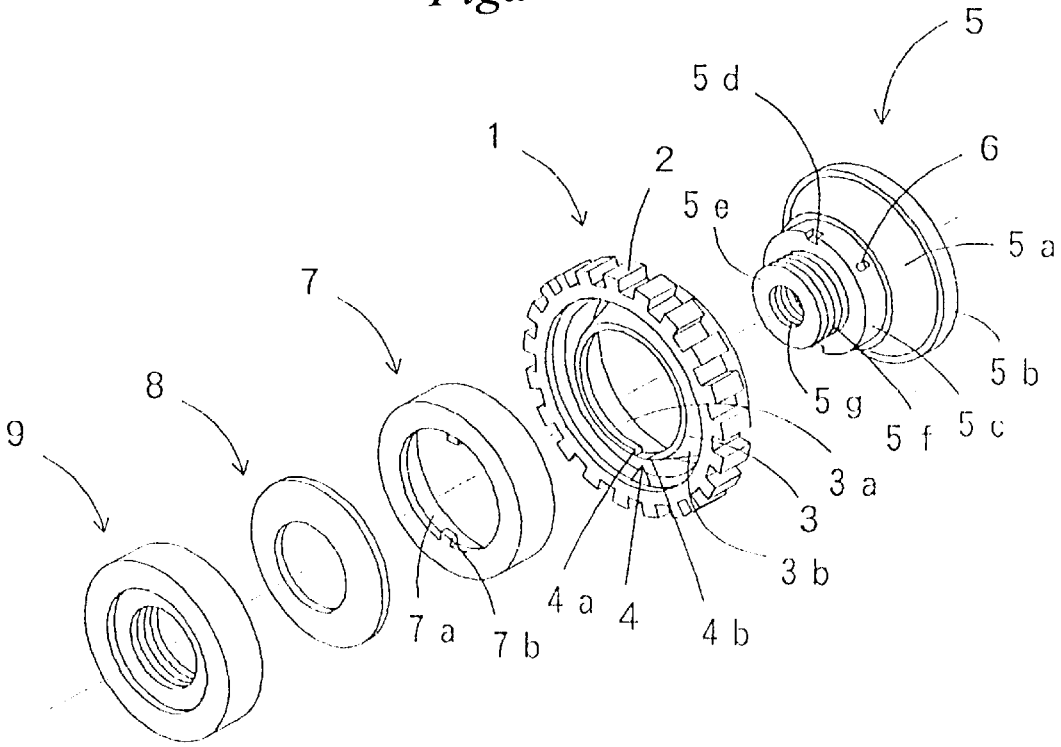
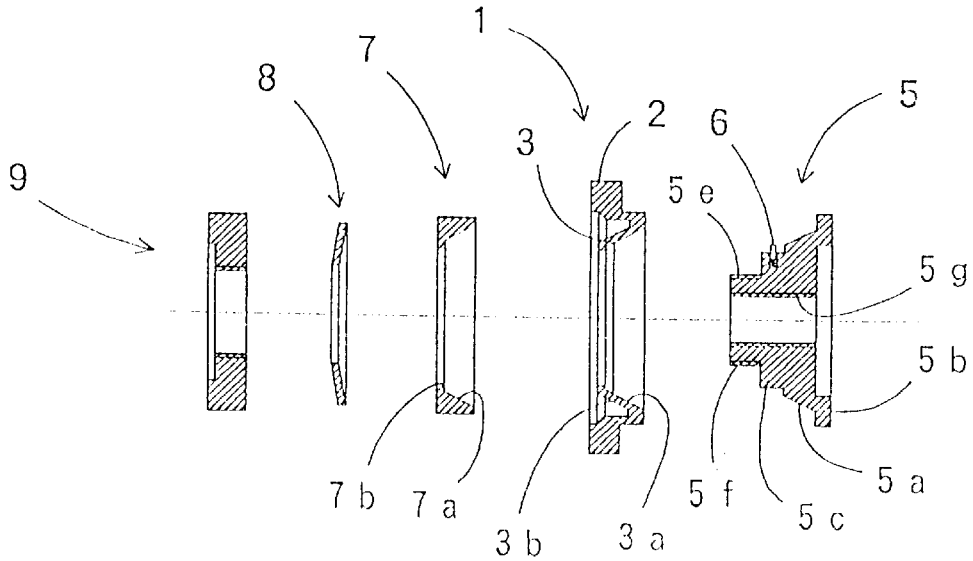
*Figure 1B*

*Figure 4A*
*Prior Art*
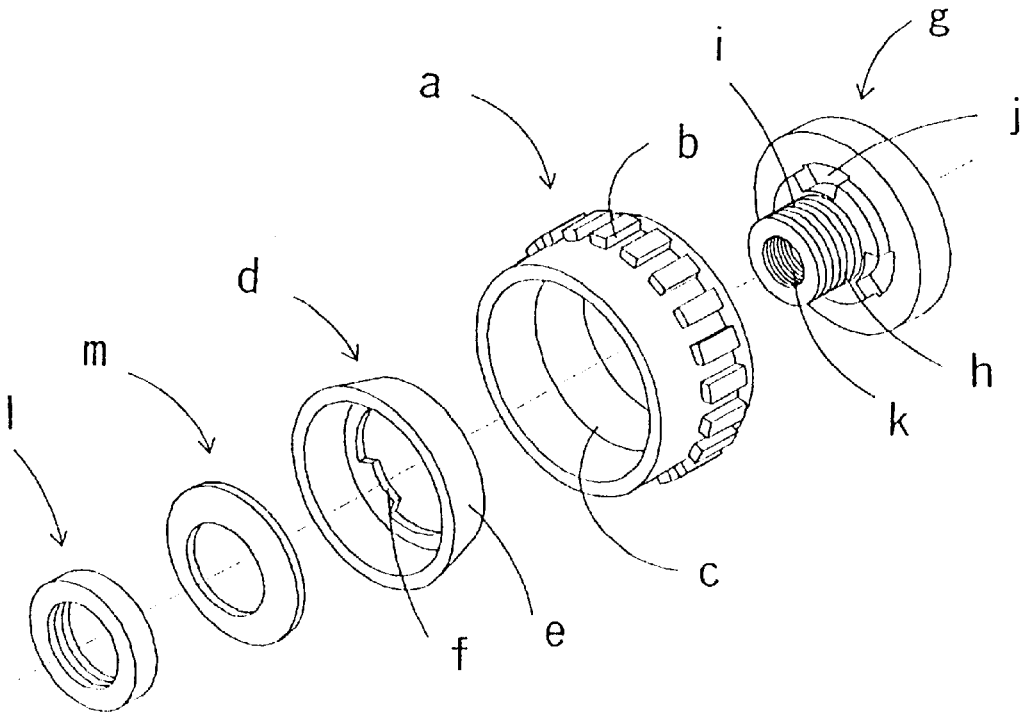
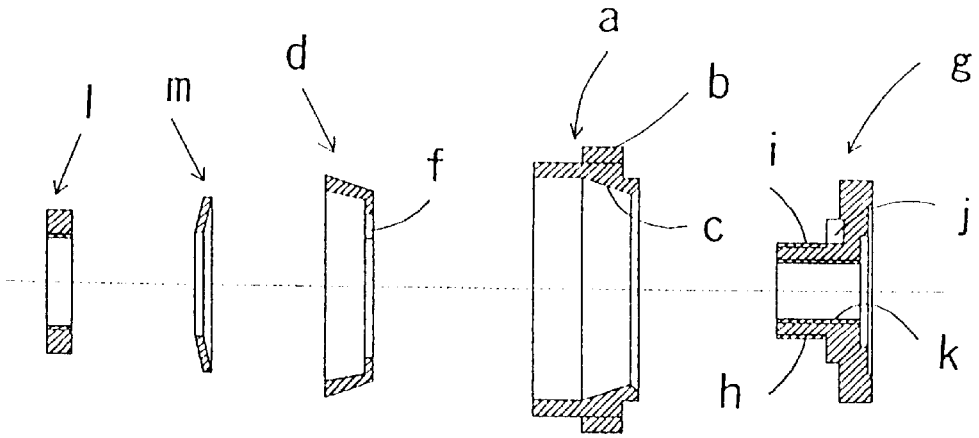
*Figure 4B*
*Prior Art*

OVERLOAD CONTROL MECHANISM FOR CARGO HANDLING MACHINE

BACKGROUND OF THE INVENTION

1. Field of the Invention

The present invention relates to an overload control mechanism for use in a lever hoist, a chain block and a cargo binding machine and, particularly, to an overload control mechanism for assuring safety during an overloaded condition and preventing a failure in the machine.

2. Description of the Related Art

In cargo handling machines, such as a lever hoist or a chain block, maximum permissible loads, for example, 1 ton or 1.5 tons, are specified depending on the type of machine in order to assure safety during cargo handling operation. The machine is so designed as to present danger and damage as long as it is used below the maximum load.

FIGS. 4A, 4B and 5 show the construction of a conventional overload control mechanism in a lever hoist. A transmission gear (a) as a driving gear has, on its outer circumference, teeth (b) which are linked with a clutch and an operation handle (both not shown). Along with the clutch and handle, the transmission gear (a) rotates in whichever direction selected. The transmission gear (a) has an inner surface (c) tapered toward the its axis.

A friction disk (d) has a friction surface (e) having the same taper angle as the tapered surface (c) of the transmission gear (a), and a plurality of locking projections (f) on its inner edge. With the friction disk (d) in contact with the tapered surface (c), a friction force taking place therebetween causes the friction disk (d) to rotate integrally with the transmission gear (a). A support disk (g) has a threaded support shaft (h) that passes through the transmission gear (a) and friction disk (d). The support disk (g) has a plurality of notches (j) on its base portion from which the support shaft (h) is extended. The support disk (g) has along its center line a fixing shaft hole (k) through which is screwed a spindle (not shown) which causes a main gear to rotate through an appropriate reduction mechanism. When a cargo is raised or lowered, a rotary force acts on the spindle (with the support disk).

The support shaft (h) of the support disk (g) is inserted through the transmission gear (a) and the friction disk (d) and a nut (l) is tightened around the support shaft (h). The nut (l) holds together a conical spring washer (m), the friction disk (d) and the transmission gear (a) to the support disk (g) so that the friction surface (e) of the friction disk (d) is engaged with the tapered surface (c) of the transmission gear (a). The tightening force of the nut (l) adjusts the friction force between the tapered surface (c) and the friction surface (e) so that the maximum permissible load is set in relation to the rotary force exerted to the spindle.

More particularly, when the weight of a cargo is within the maximum load set (corresponding to the friction force), the transmission gear (a) is rotated by the operation of the handle, friction force taking place between the tapered surface (c) and the friction surface (e) exceeds the rotary force of the spindle, and the friction disk (d) is rotated integrally with the transmission gear (a). Furthermore, the friction disk (d) and the support disk (g) rotate integrally because the locking projections (f) are engaged with the notches (j). When the support disk (g) rotates, the spindle screwed into the support disk (g) rotates, permitting the main gear to raise or lower the cargo.

When the weight of a cargo exceeds the maximum load set, the rotary force occurring on the spindle becomes greater than the friction force. A slip takes place between the tapered surface (c) and the friction surface (e), and the friction disk (d) is unable to rotate even when the transmission gear (a) is rotated by the handle operation. The support disk (g), namely the spindle, stays still, unable to raise the cargo. Any failure or damage arising from the overload is thus prevented.

In the above control mechanism, the interfaces causing a friction force are only one existing between the friction surface (e) and the tapered surface (c). Repeated sliding actions for a long-term use or under an overload condition wear gradually the friction surface (e) and the tapered surface (c), thereby reducing the friction force and causing an error in the setting of the maximum load. The gap between the friction disk (d) and the nut (l) widens, weakening elasticity of the conical spring washer (m). For this reason, the machine is rendered unable to rotate even below the maximum load.

Although tightening the nut (l) may be a solution to the problem, leaving the setting job to ordinary users is not recommended from the standpoint of safety, and furthermore, standard design of the machine does not permit the user setting. As wear advances, the user may be forced to stop the use of the machine. As a result, the life of the machine is short.

SUMMARY OF THE INVENTION

Accordingly, it is an object of the present invention to provide a compact and safe overload control mechanism which almost doubles a friction surface area without changing the overall dimension of the overload mechanism, thereby featuring substantially improved wear rate and extended product life.

To achieve the above object, the overload control mechanism for cargo handling machine of the present invention comprises a driving gear, a tapered disk shaped frustoconical and arranged on the inner circumference of the driving gear and tapered to the axis of the driving gear, a first friction disk having a tapered friction surface in contact with the tapered surface on the inner side of the tapered disk, for fixing a spindle that is inserted through the first friction disk, and a second friction disk having a tapered friction surface in contact with the tapered surface on the outer side of the tapered disk, wherein both the first friction disk and the second friction disk with the tapered disk of the driving disk clamped therebetween rotate integrally and wherein the second friction disk is fastened by a nut which is tightened onto a support shaft of the first friction disk with a spring therebetween.

Since the friction disks clamp the tapered disk from front and rear sides in the above construction of the overload control mechanism for the cargo handling mechanism, the contact area generating friction force is twice the conventional art. Load per unit area substantially drops and wear rate on the interface between the disks is thus substantially reduced.

The edge of the tapered disk has a locking ring having a locking end on one side and a guide surface on the other side while the circumference of the intermediate shaft of the first friction disk is provided with a retractable locking projection so that the first and second friction disks rotate integrally with the driving gear in one direction only during an overloaded condition.

When a cargo in excess of the maximum load is applied during a raising operation, the locking ring is not engaged with the locking projection, the tapered disk slides on its contact surfaces, and the machine is unable to hoist the cargo. Since the control mechanism is not required to work during the raising operation, the locking projection is engaged to assure a direct link in integral rotation.

The driving gear is a transmission gear, the outer circumference of which is in mesh with a gear of an operation handle.

BRIEF DESCRIPTION OF THE DRAWINGS

FIG. 1A is an exploded perspective view showing an overload control mechanism for use in a cargo handling machine according to the present invention, and FIG. 1B is a side view of the overload control mechanism;

FIG. 4A is an exploded perspective view showing an overload control mechanism for use in a conventional cargo handling machine, and FIG. 4B is a side view of the conventional overload control mechanism.

DESCRIPTION OF THE PREFERRED EMBODIMENTS

Figure 2:
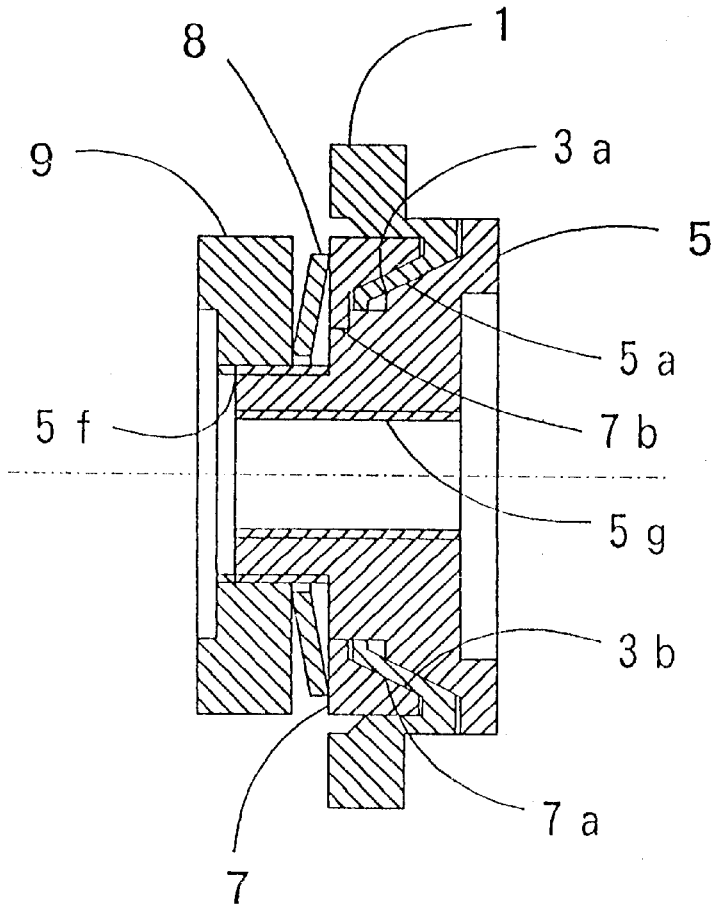
FIG. 2 is a longitudinal sectional view of the overload control mechanism.

Referring to the drawings, the embodiments of the overload control mechanism of a cargo handling machine of the present invention are discussed. FIGS. 1A, 1B and 2 show the overload control mechanism that is incorporated in a lever hoist. As shown, a driving gear (transmission gear) 1 has on its circumference teeth 2 engaged with a clutch, and is selectively rotated in one direction in coordinated action with the clutch and an operation handle (both not shown) in order to raise or lower a cargo. A tapered disk 3, which is shaped frusto-conical, has a gradually decreasing diameter to the center axis of the transmission gear 1 with an inner tapered surface 3*a* facing inward to the axis and an outer tapered surface 3*b* facing outward. The tapered disk 3 has on its end inner portion a locking ring 4 having on one side a locking end 4*a* projected in perpendicular to the inner surface of the disk 3 and on the other side a guide surface 4*b* that is continuous to the inner surface of the disk 3. The mid-diameter shaft 5*c* of a first friction disk 5 is provided with a locking projection 6 which is engaged with the locking end 4*a*.

The first friction disk 5 has, on the front side of its flange portion 5*b*, a tapered surface 5*a* which has the same taper angle as the inner tapered surface 3*a* of the tapered disk 3. The tapered surface 5*a* is tightly in contact with the tapered surface 3*a*. The mid-diameter shaft 5*c* has, on its circumference, the locking projection 6 which is elastically inwardly retractable by means of a spring. The mid-diameter shaft 5*c* has also, on its circumference, at least two notches 5*d* which are engaged with locking projections 7*b* of a second friction disk 7 as will be described later. This engagement permits the first friction disk 5 to rotate integrally with the second friction disk 7. The support shaft 5*e* of the first friction disk 5 has thread 5*f* on its outer circumference. The support shaft 5*e* is inserted through the tapered disk 3, the second friction disk 7 and a conical spring washer 8. A nut 9 is tightened around the end of the support shaft 5*e* to firmly hold them together. The first friction disk 5 has along its axial center line a threaded shaft hole 5*g* with which is engaged a spindle (not shown) for driving a hoist chain through a reduction mechanism.

The second friction disk 7 has an friction surface 7*a* having the same taper angle as the outer tapered surface 3*b* of the tapered disk 3. The friction surface 7*a* is tightly in contact with the outer tapered surface 3*b*. The second friction disk 7 has, on its end inner portion, the locking projections 7*b* in the locations corresponding to the notches 5*d* arranged on the mid-diameter shaft of the first friction disk 5. With the locking projections 7*b* engaged with the notches 5*d*, both friction disks are integrally rotated. The second friction disk 7 and first friction disk 5 clamp the tapered disk 3 therebetween. As the transmission gear 1 rotates, both the second friction disk 7 and first friction disk 5 integrally rotate to cause the spindle to rotate.

The conical spring washer 8 is slightly frusto-conical with its inner edge projected more toward one side than its outer edge. The conical spring washer 8 is interposed between the nut 9 and the second friction disk 7. When the nut 9 is tightened around the end of the shaft of the first friction disk 5, the conical spring washer 8 serves to firmly hold the transmission gear 1 between the first friction disk 5 and the second friction disk 7. The tightening force of the nut 9 and conical spring washer 8 adjusts friction force to set the maximum load.

The operation of the overload control mechanism is now discussed. The nut 9 is strongly tightened to hold firmly the tapered disk 3 of the transmission gear 1 from both sides between the first friction disk 5 and the second friction disk 7 and conical spring washer 8. When the nut 9 is tightened, the tapered disk 3 generates friction force on both sides, with its inner tapered surface 3*a* engaged with the friction surface 5*a* of the first friction disk 5 and with its outer tapered surface 3*b* engaged with the friction surface 7*a* of the second friction disk 7. By adjusting the tightening force, the maximum load of the overload control mechanism is set. Generally speaking, friction force is proportional to a contact area. With the taper angle unchanged from the conventional art, the contact area is doubled. The tightening force setting is performed in manufacturing process rather than by a user in the field in order to assure operational safety.

By manipulating the handle, the transmission gear 1 is rotated. With friction force taking place in the interfaces, the first friction disk 5 and second friction disk 7 integrally rotate as the transmission gear 1 rotates. With the locking projections 7*b* engaged with the notches 5*d*, both the first friction disk 5 and second friction disk 7 integrally rotate. The spindle loaded with a cargo generates a rotary force in one direction. When the rotary force is not in excess of the friction force (namely, the maximum load), the first friction disk 5 rotates causing the spindle to rotate. The hoist chain is raised or lowered through the reduction mechanism.

When the cargo is in excess of the maximum load, the rotary force taking place on the spindle becomes greater than the friction force. Even when the handle is manipulated, the tapered disk 3 of the transmission gear 1 slides on the friction disks and idles. With the handle shifted to raising operation, the cargo is not raised. The locking projection 6 on the first friction disk 5 slides along the inner circumference of the tapered disk 3 toward the guide surface 4*b* without engaging with the locking end 4*a* of the locking ring 4. When the handle is manipulated for the lowering operation, the tapered disk 3 slides the friction surfaces at the beginning, the locking projection 6 continuously slides the inner circumference of the tapered disk 3 until it is engaged with the locking end 4*a*. The control mechanism is not activated in the lowering operation, and the cargo is lowered. The cargo is raised in this way, and an fall in the middle of operation is thus prevented.

Figure 3:
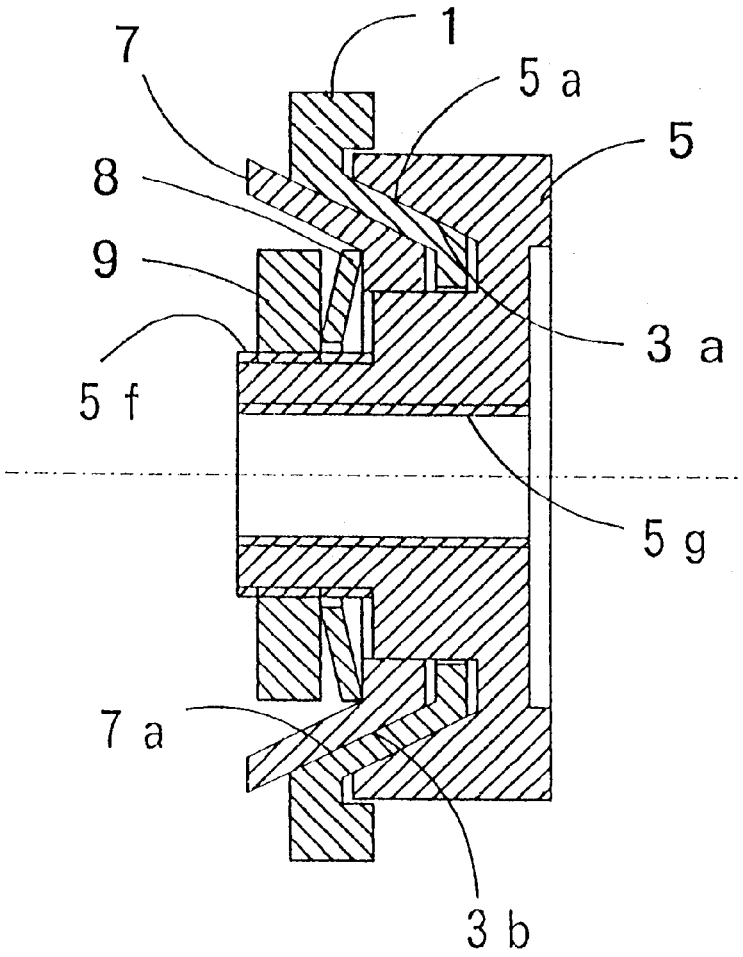
FIG. 3 is a longitudinal sectional view of another embodiment of the overload control mechanism.
Figure 5:
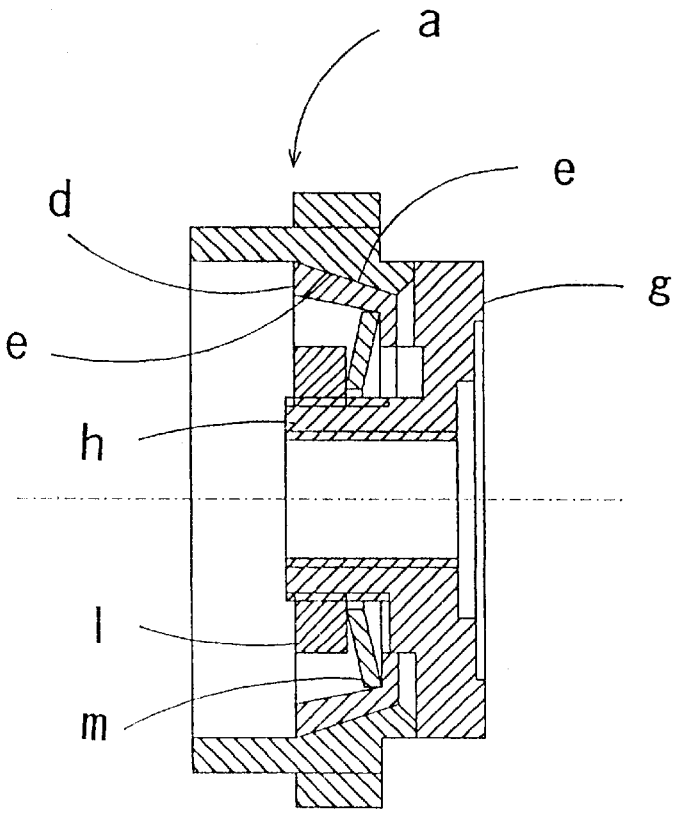
Figure 5 Prior Art
FIG. 5 is a longitudinal sectional view of the conventional overload control mechanism.

FIG. 3 shows another embodiment of the overload control mechanism of the present invention. Like elements are identified with like reference numerals. In this embodiment, the direction of taper is opposite to that in the preceding embodiment. With this arrangement, the conical spring washer 8 and nut 9 are accommodated inside the second friction disk 7, and the depth of the overload control mechanism is made smaller.

In the above embodiments, the overload control mechanism of the present invention is incorporated in the lever hoist. The present invention finds applications in a cargo handling machine such as a chain block and a cargo tightening machine.

Since the tapered disk of the transmission gear is held on both the inner tapered surface and the outer tapered surface, the transmission gear generates the friction force twice as strong as that in the conventional single tapered conical surface mechanism. For this reason, for a given friction force, a pressure half as strong as in the conventional mechanism is sufficient. This reduces the wear rate of the friction disks. Since the taper angle of the tapered disk is made large to the axis, an axial error attributed to wear is minimized and the accurate setting of tightening force is performed. Since the contact area is doubled, wear rate per unit area between the tapered disk and the friction disks is substantially reduced. Since variations in the maximum load arising from wear is thus reduced, the risk of cargo fall is substantially lowered. The product life of the tapered disk is substantially extended.

Since the transmission gear is provided with the inner and outer tapered surfaces, a larger friction force results even on the same product size as the conventional mechanism. Given the same maximum load, the size of the overload control mechanism is made more compact than the conventional mechanism. Fine adjustment of the maximum load is permitted. Since the tapered disk is held from both sides, looseness between the tapered disk and the friction disks develops more slowly with time.

What is claimed is:

1. An overload mechanism for a cargo handling machine comprising:

a driving gear;

a tapered disk arranged on the inner circumference of the driving gear and tapered to the axis of the driving gear, the tapered disk having a tapered surface, an inner side and an outer side;

a first friction disk having a tapered friction surface in contact with the tapered surface on the inner side of the tapered disk, for fixing a spindle that is inserted through the first friction disk; and a second friction disk having a tapered friction surface in contact with the tapered surface on the outer side of the tapered disk, wherein both the first friction disk and the second friction disk with the tapered disk of the driving gear clamped therebetween rotate integrally and wherein the second friction disk is fastened with a spring forth, and wherein the edge of the tapered disk has a locking ring having a locking end on one side and a guide surface on the other side while the circumference of an intermediate shaft of the first friction disk is provided with a retractable locking projection so that the first and second friction disks rotate integrally with the driving gear in one direction only during an overloaded condition.

2. An overload control mechanism for a cargo handling machine according to claim 1, wherein the spring forth is generated by a conical spring washer.

3. An overload control mechanism for a cargo handling machine according to claim 1, wherein the driving gear is a transmission gear, the outer circumference of which is in mesh with a gear of an operation handle.

4. An overload control mechanism for a cargo handling machine according to claim 1, wherein the cargo handling machine is a lever hoist.

5. An overload control mechanism for a cargo handling machine according to claim 1, wherein the cargo handling machine is a chain block.

6. An overload control mechanism for a cargo handling machine according to claim 1, wherein the cargo handling machine is a winch.

* * * * *